United States Patent [19]

Craft

[11] 4,449,837

[45] May 22, 1984

[54] RIBBON CARTRIDGE WITH BACK CHECK

[76] Inventor: James A. Craft, 1734 Cameron Ct., Lexington, Ky. 40505

[21] Appl. No.: 305,763

[22] Filed: Sep. 25, 1981

[51] Int. Cl.[3] ..... B41J 33/14

[52] U.S. Cl. ..... 400/208; 400/234

[58] Field of Search ..... 400/208, 234; 188/82.4, 188/82.7; 242/149, 155 R, 156

[56] References Cited

U.S. PATENT DOCUMENTS

| | | | |
|---|---|---|---|
| 81,729 | 9/1868 | Baker | 188/82.7 X |
| 131,402 | 9/1872 | Kingry et al. | 188/82.7 |
| 2,553,630 | 5/1951 | Capetta | 188/82.7 |
| 3,033,481 | 5/1962 | Wolk | 242/156 X |
| 3,349,887 | 10/1967 | Goff, Jr. | 400/208 |
| 3,356,202 | 12/1967 | Goff, Jr. | 400/208 |
| 3,409,113 | 11/1968 | McLean | 400/234 X |
| 3,528,536 | 9/1970 | Caudill et al. | 400/234 X |
| 3,710,915 | 1/1973 | Teichmann et al. | 400/234 X |
| 3,724,633 | 4/1973 | Korb et al. | 400/234 X |
| 3,731,781 | 5/1973 | Caudill et al. | 400/208 |
| 3,804,227 | 4/1974 | Cappotto et al. | 400/234 X |
| 3,960,259 | 6/1976 | Guerrini et al. | 400/234 X |
| 4,272,202 | 6/1981 | Schroeder et al. | 400/234 X |
| 4,299,504 | 11/1981 | Benz et al. | 400/208 |
| 4,347,008 | 8/1982 | Jagodzinski et al. | 400/208 |

FOREIGN PATENT DOCUMENTS

| | | | |
|---|---|---|---|
| 2933815 | 3/1981 | Fed. Rep. of Germany | 400/208 |
| 3003890 | 8/1981 | Fed. Rep. of Germany | 400/234 |

OTHER PUBLICATIONS

IBM Technical Disclosure Bulletin, "Typewriter Ribbon Cartridge Take-up Spool Bias Spring with Loop Unwind Control", Aldrich, vol. 24, No. 8, Jan. 1982, pp. 4312–4313.

IBM Technical Disclosure Bulletin, "Straight Release Wire for Ribbon Cartridge", Abell et al., vol. 24, No. 12, May 1982, pp. 6520–6522.

Xerox Disclosure Journal, "Ribbon Advance Mechanism", Mikes, vol. 2, No. 4, Jul./Aug. 1977, p. 47.

*IBM Technical Disclosure Bulletin,* by E. J. Lenney, entitled "Ribbon Drag Wire", vol. 18, No. 4 (Sep. 1975), p. 1093.

*Primary Examiner*—Ernest T. Wright, Jr.

[57] ABSTRACT

A ribbon cartridge having a supply spool (3) and a take-up spool hub (27) to receive ribbon (1). A section (49) of a wire (32) extends from the mounting post (33), with its pointed end resting against the take-up hub (27). Movement in the take-up direction causes a sliding action. Attempted unwinding causes the end to dig into the take-up hub (27) so that the wire section (49) immediately prevents unwinding.

5 Claims, 5 Drawing Figures

RIBBON CARTRIDGE WITH BACK CHECK

DESCRIPTION

TECHNICAL FIELD

This invention relates to a ribbon cartridge having a supply spool mounted for rotation in the cartridge and a take-up spool hub also mounted in the cartridge to receive ribbon which extends from the supply spool, out of the cartridge, and then back into the cartridge. The cartridge includes an internal, flexible member to control ribbon flow.

BACKGROUND ART

Ribbon cartridges for typewriters provide convenient, more clean-handling loading and unloading. The cartridge originally contains the supply spool of transfer medium, mounted to be controllably unwound, and a hub mounted to wind up the used ribbon.

Free unwinding of the take-up spool when the cartridge is off the typewriter can result in tangling of the ribbon. Also, insertion of a cartridge when the ribbon may unwind requires the operator to tighten the ribbon manually and to assure that used ribbon has been wound past the printing position. Where the cartridge design includes a high-friction contact with the take-up spool, such as, for example by the internal leaf spring in U.S. Pat. No. 3,356,202 to W. Goff, Jr., back checking by the friction is inherent and a special mechanism is unnecessary. In other designs the size of the ribbon or other physical relationships render unwinding an insignficant problem.

A known prior cartridge such as described in the published article by E. J. Lenney entitled "Ribbon Drag Wire" in the *IBM Technical Disclosure Bulletin,* Vol. 18, No. 4, (September 1975), at p. 1093, employs a wire wrapped around the hub of the supply spool in a cartridge as a friction brake. One end of the wire is anchored in the cartridge and the ribbon rides upon a depending leg at the other end. As the ribbon is fed, it pulls on the end it rides upon to open the portion wrapped around the hub. This frees the supply spool to move. In accordance with this invention, an internal wire mounted in a ribbon cartridge has an end contacting the hub of the take-up spool. The end is positioned to engage the hub when it moves counter to the take-up direction and to slide freely with the hub when it moves in the take-up direction. This provides physical resistance to unwinding at any angular position.

Braking assemblies for machinery having similar one-direction engagement are found in U.S. Pat. No. 81,729 to Baker and U.S. Pat. No. 131,402 to Kingry et al. U.S. Pat. No. 3,409,113 to McLean discloses a spring biased, centrally pivoted, inflexible brake member having an eccentric face as a braking surface which operates against a frame-mounted take-up spool in a typewriter. No prior art is known similarly employing the end of a flexible member to prevent unwinding in a cartridge.

Accordingly, in accordance with this invention a single wire member positioned in contact with the hub provides an economical structure which acts to prevent unwinding of the hub at any position the hub adopts. Typical alternatives to provide positive holding, as distinguished from frictional holding, would involve pawls, ratchets and the like, mounted in the cartridge or off the cartridge in a ribbon-feed mechanism, which would be more intricate and expensive and yet not infinitely variable in position of operation.

DISCLOSURE OF THE INVENTION

In accordance with this invention a flexible member is positioned in a ribbon cartridge with its end firmly contacting the take-up hub. The member is positioned on the side of the hub which moves during ribbon feed from the body of the member toward that end, thereby sliding freely. Any movement in the non-ribbon-feed direction results in the end opposing the motion of the hub and digging into it to thereby stop hub movement in the unwinding direction.

An economic ribbon cartridge is thereby provided having a self-contained, infinitely variable back check to prevent unwinding of the take-up spool. Operation involves only the member biased against the hub, and no assisting mechanism at all is employed on the typewriter.

BRIEF DESCRIPTION OF THE DRAWING

This invention is described in detail below with reference to the accompanying drawing, which illustrates the preferred embodiment, in which.

BEST MODE FOR CARRYING OUT THE INVENTION

Figure 1:
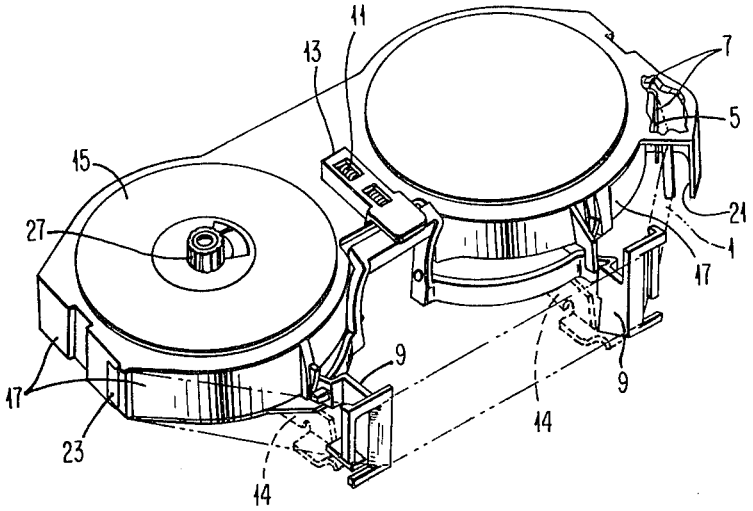
FIG. 1 is a perspective view from the top, front illustrating a cartridge incorporating this invention.

As shown in FIG. 1, this invention is embodied in a cartridge from which the typewriter ribbon 1 or the equivalent exits from a supply spool 3 (FIG. 2) by riding over a depending leg 5 of a wire 7. In this preferred embodiment the cartridge has integral, laterally spaced guide arms 9 which are pivoted to the cartridge and are biased downward by a spring 11 in top-central spring housing 13. Typewriter structures 14 contact the bottom of arms 9 and rotate upward to pivot arms 9 upward when ribbon 1 is to be raised for actual printing.

Figure 2:
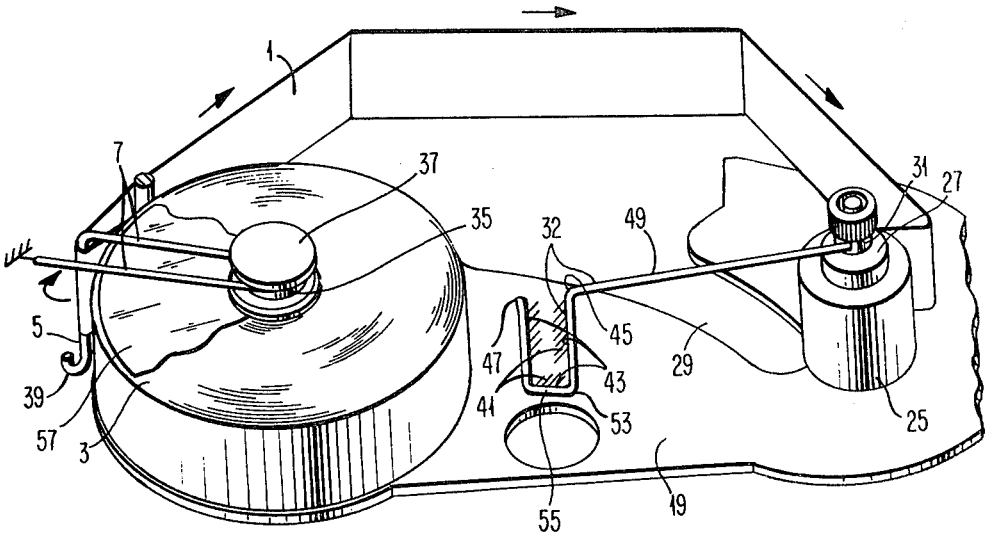
FIG. 2 is a perspective view from the rear illustrating the ribbon, major elements within the cartridge of FIG. 1, and the bottom wall of the cartridge.

The cartridge has a top wall 15, side walls 17, and a bottom wall 19 (FIG. 2). Ribbon 1 exits the cartridge through an exit opening 21 formed in side wall 17 at the area of wire leg 5. Ribbon 1 re-enters the cartridge in opening 23 on side wall 17 opposite exit opening 21.

Referring to FIG. 2, ribbon 1 is directed to a take-up spool 25, which is wound on take-up hub 27. In a manner now well known, a drive sprocket (such as the drive roller 40 in U.S. Pat. No. 3,731,781 to Caudill et al) from the typewriter enters bottom wall 19 of the cartridge through an arcuate slot 29 and contacts the periphery of take-up spool 25 to wind the ribbon 1. Take-up hub 27 has a smooth shaft 31 above spool 25 on which rests the end of a second wire 32.

Figure 3:
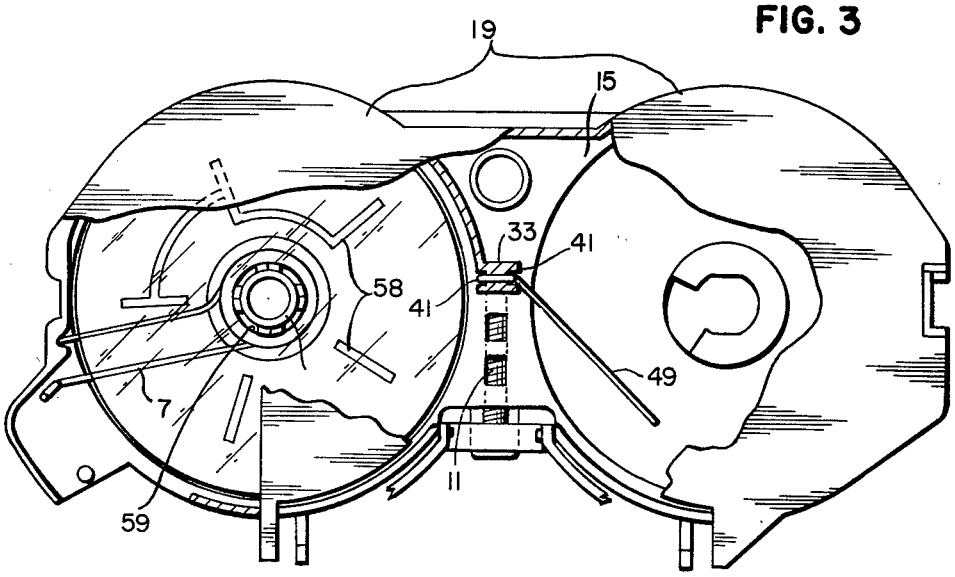
FIG. 3 is a view from the bottom with the bottom wall and spools removed showing the mounting of the spring wire and its position when relaxed.

Wire 32 extends freely from the contact with shaft 31 to a mounting post 33 (FIG. 3, shown illustratively in FIG. 2), integral with the top wall 15 of the cartridge. Wire 7, not part of wire 32, is wrapped tightly around groove 35 of an extension of the supply spool hub 37. Wire 7 is deformed to a predetermined position approximately at right angles to form depending leg 5 upon which ribbon 1 rides as it exits the cartridge. A hooked end 39 of leg 5 prevents ribbon 1 from slipping downward off of leg 5.

FIG. 3 illustrates the mounting of the wire 32 in the cartridge by showing the position of wire 32 when neither spools 3, 25 nor hubs 37, 27 are in the cartridge. Post 33 has grooves 41 on three sides, in which a corresponding, generally rectangularly shaped section 43 (FIG. 2) of wire 32 is inserted. Grooves 41 on post 33 form a three-sided outline which plane is parallel to a line between the centers of the supply hub 37 and the take-up hub 27. Stated differently, with reference to FIG. 1, its plane is parallel to the span of ribbon 1 between arms 9.

Wire 32 is bent at the junction 45 of the rectangular section 43 and the straight section 49, which extends to hub 27. Thus, with reference to FIG. 2, wire 32 is bent 40 degrees counterclockwise at junction 45, thereby pointing section 49 of wire 32 to the relaxed position shown in FIG. 3. The position of section 49 in the completed cartridge is shown in FIG. 2. Section 49 is pulled across the location for take-up hub 27. Hub 27 is inserted and section 49 is released. The 40 degree bend thereby provides a recovery force biasing the end of section 49 firmly against shaft 31 of take-up hub 27.

Wire 7 in the configuration as disclosed is substantially identical to prior published and commercially sold tensioning systems for a supply ribbon in a cartridge. It therefore constitutes no part of this invention and will not be discussed in detail. One end of wire 7 is anchored to the cartridge. The end carrying depending leg 5 is pulled by ribbon 1 as the ribbon 1 is fed. This relaxes the normally firm grip of wire 7 around hub 37 and allows rotation of hub 37 to thereby feed ribbon 1 from supply spool 3.

The generally rectangular section 43 of wire 32 is actually bent somewhat to create a grasping bias on post 33. This is accomplished by a bend in junction 53, the next corner of section 43 from junction 45. That bend is inward so that the opening at the central leg 55 of the section 43 is about one-third larger than the opening between junction 45 and the end 47 of rectangular section 43 when relaxed.

It will be apparent that the foregoing dimensions are essentially only matters of optimum design. Increasing the disclosed angle at junction 45 requires a greater bending of section 49 after the cartridge is assembled and therefore provides a greater biasing force. The degree of inward bending of section 43 controls grasping bias when the section 43 is flexed over post 33, which bias provides friction to keep wire 32 in place. As indicated best in FIG. 3, a moderately stiff plastic disk 57, with a central hole 59 to admit supply spool hub 37 is included in the cartridge. Top wall 15 has a series of ridges or ribs 58 which hold disk 57 in a plane between supply spool 3 and wire 7. Disk 57 holds ribbon 1 against taking a coned or telescoped configuration under unwinding pressures which would bind wire 7 from its intended movement.

Finally, the end of section 49 of wire 32 is cut at 45 degress so as to provide a sharp, digging contact with hub 27.

The mounting of wire 32 employing generally rectangular section 43, the configuration and interaction of wire 7 with supply spool 3 and supply-spool hub 37; and the interaction of ribbon 1 with wire 7 form no part of the essential contribution of this invention. This invention contributes the section 49 and the interaction with take-up hub 27 as described.

The final cartridge is as it appears in FIG. 1 with significant internal elements as shown in FIG. 2 and FIG. 3. The cartridge is simply placed on a typewriter or other printer adapted to use such a cartridge. As is generally conventional, the cartridge fits on mating members on the typewriter so as to be positioned for printing. A drive sprocket from the typewriter enters the bottom of the cartridge through slot 29 and rests against the outside of take-up spool 25. The drive sprocket and slot interaction is now well known as shown, for example, in U.S. Pat. No. 3,731,781 to Caudill et at.

Figure 4A:
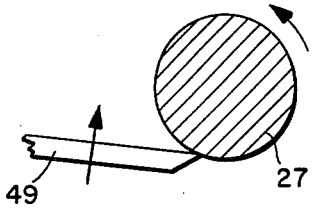
FIGS. 4*a* and 4*b* illustrate the braking action.
Figure 4B:
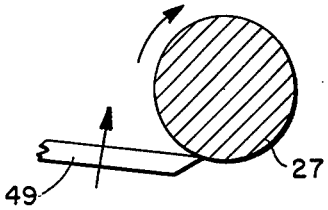

Operation of the unwinding check mechanism is as shown in FIGS. 4*a* and 4*b*. The arrows through section 49 represent the direction of the spring recovery bias force. FIG. 4*a* illustrates the take-up hub 27 rotating in the normal direction to wind ribbon 1. The body of section 49 is located so that the hub movement is in the direction from the body toward the end, and a sliding contact with the hub 27 results. Movement is substantially unobstructed.

FIG. 4*b* illustrates the inherent back-checking operation. When hub 27 moves in the unwind direction, movement is toward the end of section 49. Section 49 is firmly tensioned toward the center of hub 27 and therefore engages the hub 27. The 45 degree angle at the end of section 49 presents a point which assists in providing a firm engagement. This applies a force which, being along the length of section 49, is strongly resistive to flexing. A strong counter force effective to brake the hub 27 results. In the preferred embodiment hub 27 is made of a hard synthetic resin which yields slightly to the digging action of wire 32.

Modifications of the preferred embodiment will be apparent, and other, not apparent modifications and adaptations may be devised while nevertheless employing the true invention here disclosed. Accordingly, patent protection should not be limited by the preferred embodiment, but should be provided by law.

What is claimed is:

1. A ribbon cartridge having a supply spool mounted for rotation in the cartridge and a take-up spool hub mounted in said cartridge to receive ribbon which extends from said supply spool, out of said cartridge, and then back into said cartridge, said cartridge comprising a flexible member mounted inside said cartridge with a part in contact with said hub, said part being positioned to engage said hub when said hub turns counter to the take-up direction to stop movement of said hub and to slide on said hub when said hub turns in the take-up direction to permit movement of said hub.

2. The ribbon cartridge as in claim 1 in which said flexible member is a wire and said part includes an end of said wire.

3. The ribbon as in claim 2 in which said wire has a first section having an end biased against said hub and a second section engaged with a post integral with said cartridge.

4. The ribbon cartridge as in claim 3 in which said post has at least two grooves and said second section is bent to form three sides of a generally rectangular configuration, opposite sides of said three sides fitting in said two grooves, said wire being bent at the corner of said first section and said second section to provide a recovery force biasing the end of said first section against said hub.

5. The ribbon cartridge as in claims 2, 3 or 4 in which said wire has an end cut at an angle point to dig into said hub when said hub turns counter to the take-up direction.

* * * * *

UNITED STATES PATENT AND TRADEMARK OFFICE

CERTIFICATE OF CORRECTION

PATENT NO. : 4,449,837

DATED : May 22, 1984

INVENTOR(S) : J. A. Craft

It is certified that error appears in the above-identified patent and that said Letters Patent are hereby corrected as shown below:

On the face page of the patent, after "[76] Inventor (etc.)" show a separate line --[73] Assignee: International Business Machines Corporation, Armonk, N.Y.--.

At column 4, line 52, after "ribbon" insert --cartridge--.

Signed and Sealed this

*Twenty-sixth* Day of *February 1985*

[SEAL]

*Attest:*

DONALD J. QUIGG

*Attesting Officer* *Acting Commissioner of Patents and Trademarks*